United States Patent [19]

Perez

[11] 3,961,506

[45] June 8, 1976

[54] LOCKS

[76] Inventor: Antonio L. Perez, 15 Phoebe Mansions, Middle Ave., North End, Port Elizabeth, Cape Province, South Africa

[22] Filed: Oct. 7, 1974

[21] Appl. No.: 513,039

[30] Foreign Application Priority Data

Oct. 9, 1973 South Africa ..... 73/7867

[52] U.S. Cl. ..... 70/363; 70/375; 70/376; 70/384; 70/411

[51] Int. Cl.[2] ..... E05B 9/04; E05B 15/14; E05B 19/18; E05B 27/00

[58] Field of Search ..... 70/363, 376, 382, 383, 70/384, 385, 398, 411, 378, 397

[56] References Cited

UNITED STATES PATENTS

| | | | |
|---|---|---|---|
| 408,447 | 8/1889 | Volkerts | 70/363 |
| 510,234 | 12/1893 | Bexell et al. | 70/363 X |
| 1,036,764 | 8/1912 | Wilson | 70/398 X |
| 1,998,900 | 4/1935 | Lombardo | 70/363 |
| 2,019,400 | 10/1935 | Deutsch | 70/411 |
| 2,024,030 | 12/1935 | Deutsch | 70/363 X |
| 2,194,469 | 3/1940 | Fremon | 70/378 X |
| 3,084,533 | 4/1963 | Monahan | 70/363 |

FOREIGN PATENTS OR APPLICATIONS

| | | | |
|---|---|---|---|
| 17,783 | 9/1913 | Denmark | 70/363 |
| 324,617 | 12/1902 | France | 70/397 |
| 713,765 | 9/1966 | Italy | 70/363 |
| 234,878 | 5/1969 | U.S.S.R. | 70/384 |

*Primary Examiner*—Paul R. Gilliam
*Assistant Examiner*—Carl F. Pietruszka
*Attorney, Agent, or Firm*—Mason, Fenwick & Lawrence

[57] ABSTRACT

A lock and key assembly wherein the key is adapted to co-operate with the lock is characterized in that the key has adjustable formations thereon, and the lock has complementarily adjustable tumblers so as to afford a variable combination of the lock and key assembly.

5 Claims, 9 Drawing Figures

20
17
19
18
1
IV
IV
1
11
16
10
15
14
9
7
8
12
22
10
2
2
13
5
4
21
6
III
III
II
28
8
II
24
4
24
23

3
23
27
26
25

4
21
6

8
28
5
1
16
11
11
16
17

LOCKS

This invention relates to locks of the type which are operable by a key and more particularly to tumbler locks.

Known keys have fixed formations thereon in a predetermined combination and are made to co-operate with complementary formation in a lock. Access is therefore easily gained by an unauthorized person to a locked space by obtaining the respective key or a copy thereof. Keys are consequently safeguarded and when a key is lost, the whole lock and key assembly is often replaced.

Lock and key assemblies to which this invention relates operate on the principle that a tumbler in the lock is displaced by means of a key so that a formation in the tumbler aligns with a complementary formation to the lock to afford movements of the in past the formation in the lock. The assembly is thus unlocked.

Depending on the type of lock, the tumblers may take various forms and may be lever tumblers or in the case of cylinder locks, they may be pins, discs or side bar tumblers.

It is the object of this invention to provide a lock and key assembly wherein the combination thereof may be easily changed at will.

According to this invention there is provided a lock and key assembly wherein a key is adapted to co-operate with a lock, the assembly being characterized in that the key has adjustable formations thereon and the lock has complementarily adjustable tumblers so as to afford a variable combination of the lock and key assembly.

Further features of the invention provide for the formations of the tumblers to be adjustable by independent screw threaded members, for the lock to have longitudinally extending pin tumblers in which case the key has longitudinal formations which may take the form of spindles.

Preferred embodiments of the invention are described below by way of example only, reference being made to the accompanying drawings in which:

FIG. 1 is a cross-sectional side elevation of a lock and key assembly in accordance with the invention wherein;

FIG. 1 (*a*) shows the lock, and

FIG. 1 (*b*) shows the key;

Figures 1A, 1B, 2, 3, 4:
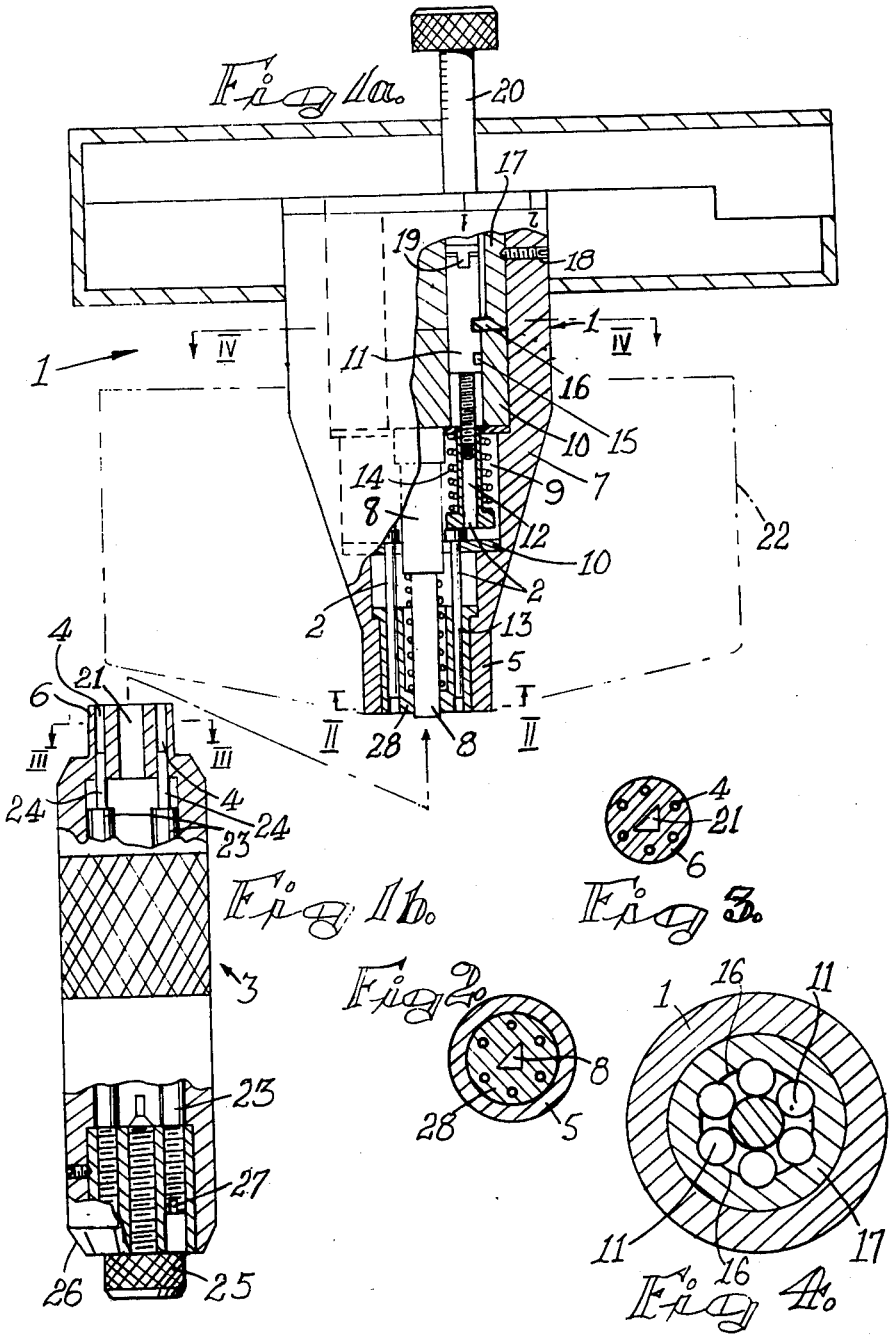
FIGS. 2, 3 and 4 are end elevations along II — II, III — III and IV — IV, respectively.

In one embodiment of the invention illustrated in FIGS. 1 to 4, a lock 1 has longitudinally located pin tumblers indicated generally at 2 and a key 3 has complementary longitudinal formations for operating the pin tumblers 2. The tumblers 2 extend in the lock 1 and terminate near one end 5 thereof, said end being adapted to receive therein the end 6 of the key 3 with the formations.

It is to be appreciated that a longitudinal pin tumbler lock is very compact and will therefore be suitable for lock-in-handle arrangements. A handle 22 is shown in ghost lines in FIG. 1.

More specifically and as shown in FIGS. 1, 2 and 4 the lock includes and elongated hollow body 7 having an axial pintle 8 rotatably mounted therein which defines an annular passage 9 between the body and the pintle. A set of pin tumblers 2, six for example, are equally spaced circumferentially and located longitudinally in the passage 9. Suitable supports 10, rotatably mounted in the body, retain the tumblers 2 and the pintle 8 in position. It will be understood that any number of tumblers may be employed.

Each tumbler 2 includes two attached parts 11 and 12 described more fully below and a pin formation 13, all arranged in line with the latter being slightly axially offset from the parts 11 and 12 toward the pintle 8. Each pin formation 13 terminates near the end 5 of the lock and a spring 14 is provided around the part 12 to bias the associated tumblers toward the locked position as shown in FIG. 1*a*. Furthermore, each tumbler 2 has a recess 15 in the part 11 thereof which, when aligned with projections 16 fixed in the body, allows the tumbler recess to pass thereover. That is, when the recesses 15 in the tumblers 2 are all aligned with their respective projections 16, the pintle 8, the supports 10 and the tumblers 2 may be rotated in the body, thereby unlocking the assembly.

These projections may be of any known type and in this embodiment are arranged so that the part 11 of each tumbler may be rotated about its own axis and be moved longitudinally. As shown most clearly in FIG. 4, the projections 16 are provided on a hollow cylindrical body 17 at one end thereof and are spaced apart and project inwardly. The body 17 is axially located inside the lock body 7 near the end thereof remote from the end 5 and is secured therein by means of a grub screw 18. The parts 11 of the tumblers are partially accommodated between the projections 16 and it is readily apparent that the set of tumblers cannot be rotated in the lock in either direction unless the recesses are aligned with the projections.

The pintle 8 terminates in a hollow body to which the lock body 7 is attached remote from its end 5. The end of the pintle in the body is associated with a locking bolt (not shown) such that rotation of the pintle causes the bolt to slide in or out of the body.

A characteristic of the tumblers 2 is that they are extensible in length, and the locations of the recesses are thereby adjustable. Thus, the parts 11 and 12 are screw threaded and are co-operating male and female parts. The male part 11 can then be screwed in or out of the female part 12 to vary the effective length of the tumbler 2 and the longitudinal location of the corresponding recess 15. The male part 11 is also provided with a diametral slot 19 in its free end to enable a screw drive 20 to operate the tumbler 2. To prevent the part 12 from rotating a suitable retaining piece is provided.

It will be appreciated that when the effective length of any tumbler is altered the combination of the lock is thereby altered as well. In order to bring the recess 15 in a particular tumbler in line with its projection 16, a different amount of longitudinal movement of the associated tumbler 2 is required.

The key 3 includes a hollow body one end 6 of which is shaped to fit into the end 5 of the lock 1 where the pin formations 13 and pintle 8 terminate. A central perforation 21 complementary in transverse shape to the pintle 8 enables the key to be suitably orientated. To this end the pintle 8 and consequently the respective perforation 21 in the key, have a non-circular cross-section and may be triangular for example or may have a locating notch and groove respectively.

Equally spaced around the perforation 21 and extending longitudinally from near the one end 6 of the key to the opposite end thereof is a set of spindles 23 corresponding to the positions of the pin formations 13. Each spindle 23 is screw threaded onto the end 6 of the key so that its effective length may be altered in accordance with the change in the effective length of the corresponding tumbler 2. Each spindle is provided with a pin 24 attached at its end in the end 6 of the key. These pins are located in apertures 4 in the key, the apertures being circumferentially arranged in accordance with the configuration of the pin formations 13 in the lock.

It is preferable to have the screw threads of the spindles 23 of the same pitch as the screw threads on the tumblers 2. Thus, when a tumbler 2 is altered in length by rotating its part 11 by for instance three revolutions, the respective spigot 23 should also be turned by three revolutions.

Removably located centrally in the outer end 26 of the key is a screw driver 25 which may be removed and inserted into the suitable apertures in the end 26 of the key to engage with slots 27 on the ends of the spindles to enable the spindles to be turned readily. The spindles 23 and the respective tumblers 2 are preferably correspondingly numbered.

In use, the key 3 and lock 1 are set on a particular combination. The end 6 of the key 3 is inserted into the lock 1 and simultaneously the pins 24 on the spindles 23 will urge the pin formations 13 and hence the tumblers 2 into the lock body against the springs 14 such that the recesses 15 are aligned with the projections 16 in the lock. The pintle 8, the tumblers 2 and the supports 10 may then be rotated.

When the length of a tumbler 2 is altered by turning the male part 11 thereof with the screw driver 20, the original combination is upset and in order to be able to turn the lock, the respective spindle in the key 3 must be turned to the same extent so that when the key is inserted in the lock the recesses 15 will again be aligned with the projections 16.

In order to prevent fouling of the interior of the lock a frontal spring biased closure member 28 is located to close the outer end 5. When the key 3 is inserted in the lock 1, the closure member 28 will be urged inwardly against the action of its spring.

It will be appreciated that with a lock and key assembly of the above type, all the doors of a house, for example, can have the same combination, and only one key is required. The combination can then be changed periodically and at will. Such a lock is then particularly useful in security installations.

Figure 5:
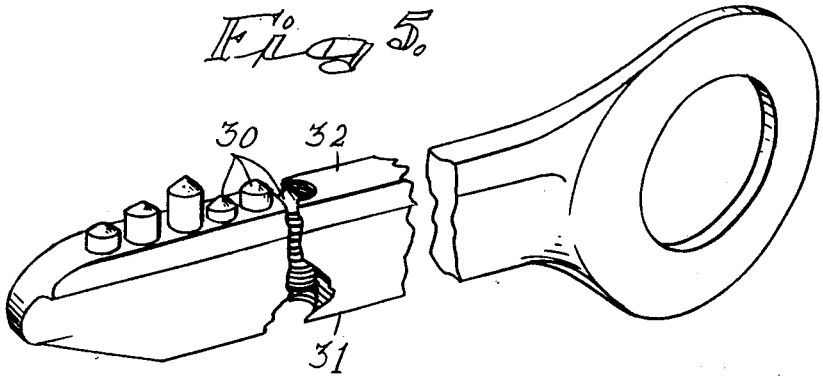
FIG. 5 is a perspective view of a conventional key modified in accordance with the invention.

Other forms of the invention are envisaged and in particular, the invention can be applied to conventional tumbler locks. A key for use with pin tumbler lock is shown in FIG. 5. The key has transverse screw-threaded holes therethrough in which grub-screws 30, operable from one side edge 31 of the key, are accomodated. The screws project from the opposite side edge 32 of the key to form lock engaging formations. It will be appreciated that by turning the grub-screws, the individual formations of the key may be raised or lowered and when the same is done to the pin tumblers of the relevant lock, the combination will be altered.

Figure 6:
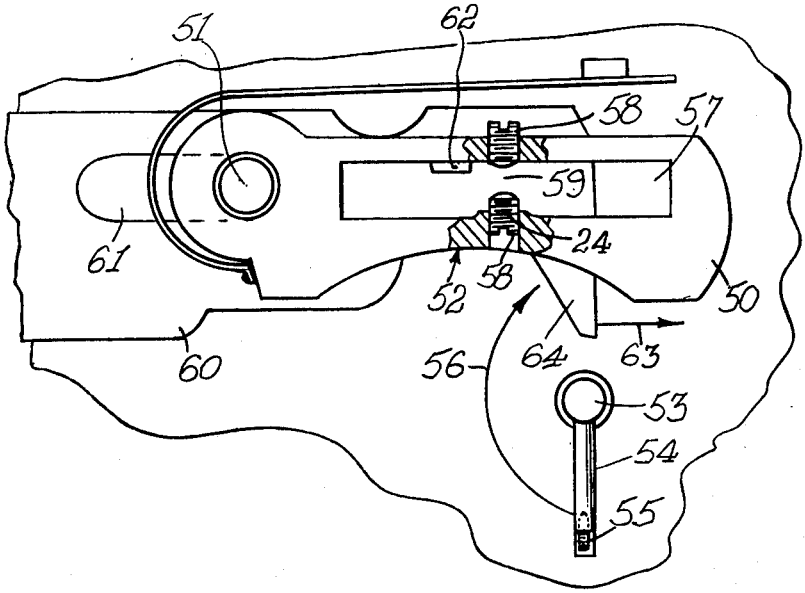
FIG. 6 is a side elevation of the interior of a lever tumbler lock showing the tumbler and key modified in accordance with the invention.

FIG. 6 of the drawings shows the internal operative elements of a lever tumbler lock. Mounted inside a lock body (not shown) is a lever tumbler 50 which is pivotted as at 51 and which includes a curved recess 52 in its lower surface. The lock body, in known manner, has an aperture therein into which a key 53 may be inserted to engage the tumbler 50. The key has a transverse formation 54 thereon and a grub-screw 55 engages in the end thereof by means of which the length of formation 54 may be adjusted. On rotation of the key 53 in the direction indicated by the arrow 56 in FIG. 6, the grub-screw 55 contacts and moves along the recess 52 in the tumbler to lift the latter.

A slot 57 is provided through the tumbler and two grub-screws 58 project into the slot from each side thereof through the tumbler at adjacent locations. A gap 59 is defined between the facing ends of these screws which is adjustable in dimension by turning the grub-screws.

A bolt formation 60 is slidably mounted in the lock to move in each direction transverse to the axis of the tumbler pivot and the axis of the grub screws 58. To this end, a slot 61 is formed in the bolt which is located around the tumbler pivot 51. The bolt is provided with a projection 62 which protrudes into the slot 57 of the tumbler and which abuts the upper grub-screw 58 when the bolt is moved in the direction of the arrow 63 in FIG. 6. The lock is thereby locked. A further projection 64 extends downwardly from the one end of the bolt formation at a position approximately above the position of the key when the latter is inserted.

In use, when the key is turned in the lock in the direction shown by the arrow 56, the grub-screw 55 thereon contacts the recess 52 in the tumbler and the latter is lifted. At the same time the key contacts the projection 64 on the bolt to move the latter in the direction indicated by the arrow 63, this movement being allowed since the tumbler is in the raised position and the projection 62 thereon can pass through the gap 59 between the grub screws 58.

It will be readily appreciated that by turning the grub-screws 58 on the tumbler and the grub screw 55 on the key, the combination of the lock and key assembly may be varied at will.

Of course, a plurality of tumblers may be provided in the lock of a similar type and in similar orientations to the tumbler 50. The settings of all the grub-screws will be different in any particular combination and the lengths of the lock engaging formations on the complementary key will correspond to these settings.

A yet further lock assembly is now described with reference to FIGS. 7 and 8. This lock is of the lever tumbler type wherein the tumblers are arranged to slide vertically when operated by a key and are not pivotally mounted. The lock is perhaps of a simpler construction than those heretofore described and the setting of a particular combination is more easily accomplished as will become apparent.

Once again it is to be appreciated that a plurality of tumblers can be provided in the lock, but for the sake of simplicity, only one such tumbler is described. Other tumblers will be of the same type and will be similarly orientated.

Figure 7:
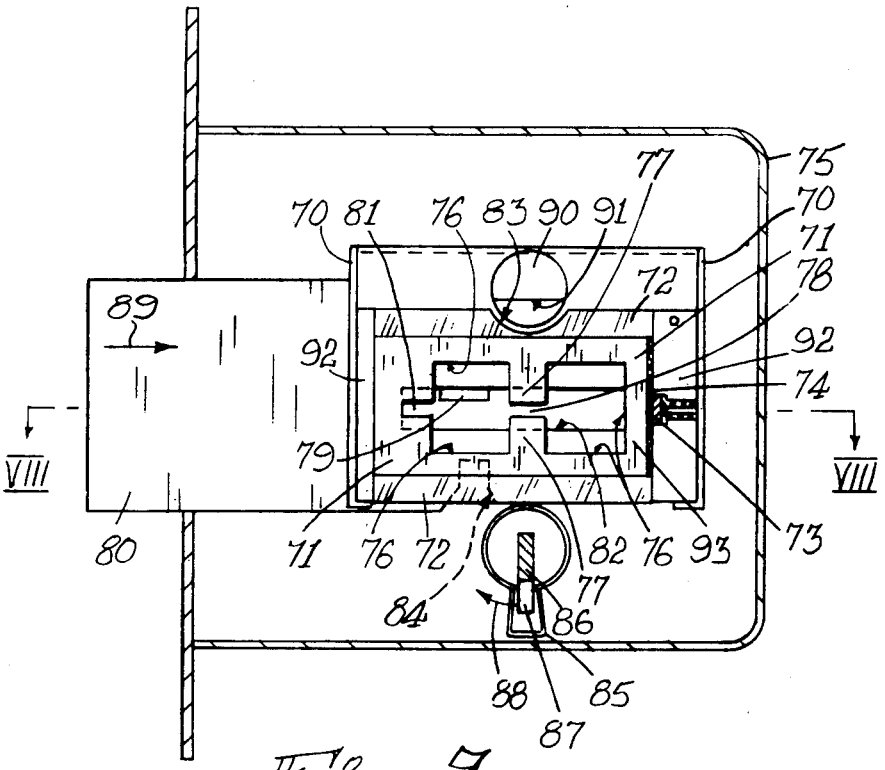
FIG. 7 is a schematic side elevation of the part of the interior of an alternative lock.
Figure 8:
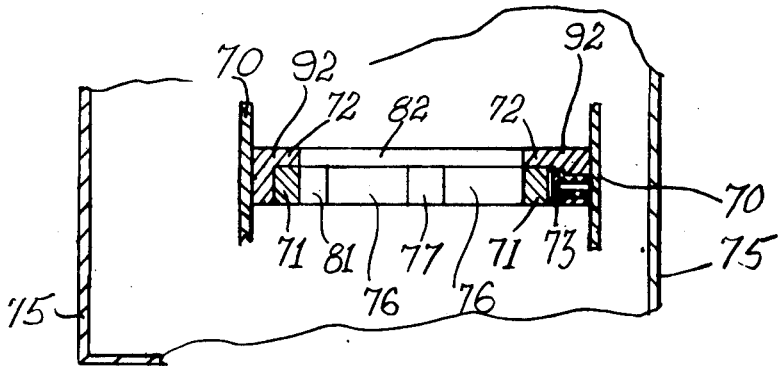
FIG. 8 is a section along VIII — VIII in FIG. 7 showing only one tumbler.

With reference to FIGs. 7 and 8, a tumbler is mounted between spaced parallel guide plates 70 in a lock body 75 such that it may be moved vertically. The tumbler comprises two abutting and, in this embodiment, vertically orientated plates 71 and 72 which are frictionally held together in the lock but may be moved vertically relative to each other by overcoming this frictional force. The one plate 72 is larger than the other plate 71 and has transversely projecting shoulders 92 along its vertical edges between which the smaller plate 71 is mounted. A spring biased element 73 is accommodated in an aperture in one of the shoulders 92 and abuts the adjacent edge 93 of the smaller plate 71 to hold the two plates together frictionally. The edge 93 of the smaller plate 71 and the abutting surface of the element 73 are serrated, as at 74, so that an effective frictional engagement between these parts is afforded.

The smaller plate 71 has a centrally located cut out slot 76 therein as illustrated and two fixed inwardly projecting formations 77 are provided in the slot to define a gap 78 therebetween. A transverse projection 79 on a slidable bolt 80 protrudes through the slot 76 and this projection must pass through the gap to unlock the lock. A recess 81 conforming approximately to the transverse dimension of the projection 79 is formed in the one vertical side of the slot remote from the element 73. The larger plate 72 which also has a larger vertical dimension than that of the smaller plate 71 has a rectangular slot 82 therein dimensioned not to provide any obstruction to the movement of the projection 79 on the bolt.

The top edge of the larger plate 72 has a part-circular recess 83 therein and a further recess 84 shown in ghost lines in FIG. 7 is provided in the bottom edge of the bolt adapted to be engaged by a bolt releasing formation 85 rotatably mounted in the lock body. This formation 85 is arranged to receive part of a key 86 therein and is turned by the latter. The key 86 has a plurality of adjustable transverse tumbler-engaging formations 87 thereon. These formations may be screwed in or out of the key to allow their adjustment and are preferably provided with a series of marks thereon to indicate their effective lengths. The formations are located to abut the bottom edges of the larger plates 72 when the key is inserted and turned. A solid cylindrical member 90 is rotatably mounted in the lock body transverse to and above the recesses 83 in the top edges of the larger plates 72. This member has a part circular cross-section and has a longitudinal recess 91 therein which forms a flat face along part of the length of the member. Springs are provided in the lock body to bias the plate pairs downwardly independantly.

In use, the key is inserted in the lock and engages in the bolt-releasing formation 85. When the key is turned in the direction shown by the arrow 88 in FIG. 7 the formations 87 on the key abut the bottom edges of their respective larger plates 72 to lift each composite tumbler such that the gaps 78 in each smaller plate are in allignment with the path of movement of the projection 79 in the bolt. Upon further rotation of the key, the bolt releasing formation being turned in unison therewith engages the recess 84 in the bolt to move the latter in the direction indicated by the arrow 89 in FIG. 7. The assembly is thereby unlocked. The bolt recess 84 is so located, and the bottom edges of the larger plates 72 are shaped such that the tumblers are lifted to their aligned unlocking positions before the bolt is moved by the key.

To reset the combination of the lock at will, the key is inserted into the lock and turned to lock the lock and the bolt projection 79 is located in the recesses 81 in slots 76 of the larger plates 71. It is to be appreciated that the plates 71 are now effectively held in position by the bolt projection 79 and may not be moved vertically.

The key is removed and the effective lengths of the tumbler engaging formations are altered at will. The member 90 is rotated such that it abuts the top edges of the larger plates 72 and forces these plates downwardly against the frictional engagement between the edges 93 of the smaller plates 71 and the elements 73 until all the larger plates 72 are at the same level. The member 90 is then turned such that the recess 91 directly faces the top edges of the larger plates 72.

The key is inserted into the lock and turned in the direction indicated by the arrow 88. The formations 87 on the key will abut the bottom edges of the larger plates 72 and force these upwardly in the lock and relative to the smaller plates 71. The lock combination is thereby reset and further turning of the key will begin to move the bolt and the projection 79 through the gaps 78 of the tumblers.

It is readily apparent that a lock of the above described type is more easily set to a new combination than those described with reference to FIGS. 1 to 5. To change the combination only the key need be manually adjusted and the lock is simply set by rotating the key therein.

Obviously other embodiments of a lock of this general type are possible within the scope of the present invention. In particular the lock could include pivotally mounted tumblers, each tumbler comprising two relatively movable plates. To this end, each tumbler could include two plates mounted on a common pivot in the same plane with the one plate accommodated in a cut out slot in the other plate. The free edge of the inner plate would be provided with serrations engaging with a serrated element between this edge and the adjacent inner surface of the outer plate. This element would be fixed relative to the outer plate and be spring biased toward the serrated edge of the inner plate. A construction of this type would allow the lock to have a smaller transverse dimension than that described with reference to FIGS. 7 and 8.

The adjustable formations on the complementary key are provided with spaced marks to allow a user of the key to memorise the particular combination of the key should this become lost. A similar key could then be obtained and set to the particular combination.

In key and lock making, size is often an important consideration and the smaller the lock or key the better. In the latter embodiment it will be appreciated that the plates 72 will be moved upwardly by the formations on the key by amounts equal to the lengths of the respective key formations. Thus, if it is required that the plates be moved by amounts of up to five millimeters, the corresponding key formations must be able to be extended up to five millimeters in length. When pivotted lever tumblers are employed, however, to obtain say five millimeters of movement of the end of the tumbler, the corresponding key formations may be smaller. For this reason, pivotted lever tumblers are preferred.

It will be appreciated that various other forms of the invention are possible within its scope and the tumblers need not only be changed by screw threaded members but may be effected by eccentric cams for example.

What I claim as new and desire to secure by Letters Patent is:

1. A lock and key assembly wherein the key is adapted to co-operate with the lock, the lock comprising:

a substantially cylindrical hollow body including a key receiving opening at one end;

an axial pintle centrally rotatably mounted in said body, having a first shaped end terminating in said key receiving opening and a second end projecting through a second end of said body and connected to a movable locking bolt;

a plurality of pin tumblers equally spaced apart circumferentially and mounted longitudinally in a space between said pintle and said body so as to be rotatable about the longitudinal axis of the pintle and longitudinally movable in said body and wherein each tumbler is extensible in length and comprises a pin formation extending inwardly from said key receiving opening and co-operating screw threaded male and female parts with the one part terminating near said second end of the body and having a transverse recess in its side;

means for biasing said pin tumblers towards the key receiving opening of said body;

a plurality of radially inwardly extending projections in said body arranged to allow rotation of said pintle and tumblers when said recesses in the tumblers are aligned therewith; and openings in said second end of the body to enable each of said one tumbler part to be manipulated to vary the tumbler length;

and the key comprising a substantially cylindrical hollow body having one end shaped to fit into said key receiving opening in the lock body;

an aperture centrally formed in said one end complementary in transverse shape to the shaped pintle end;

a plurality of spindles equally spaced apart circumferentially in said key body which extend in passages formed in said one end towards the opposite end of the body, the spindles at said opposite end being screw threaded onto the key body and openings being provided in this end to enable adjustable manipulation of the spindles.

2. An assembly as claimed in claim 1 in which said one part of each tumbler and the end of each spindle adjacent the respective openings in the lock body and key body have slots therein for engagement by a screw driver.

3. An assembly as claimed in claim 2 in which the end of the key body remote from the lock engaging end thereof carries a removable screw driver dimensioned to be capable of insertion into said openings.

4. An assembly as claimed in claim 1 in which the screw threads of said male and female tumbler parts and said screw threads of the spindles and key body have the same pitches.

5. An assembly as claimed in claim 1 in which a frontal spring biased closure member is located in said key receiving opening in the lock boss which is axially movable into the lock body.

* * * * *